US006136100A

United States Patent [19]

Panchanathan

[11] Patent Number: 6,136,100

[45] Date of Patent: Oct. 24, 2000

[54] RARE-EARTH ALLOY POWDERS FOR MAGNETS AND PROCESS FOR MAKING MAGNETS FROM RARE-EARTH ALLOY POWDERS

[75] Inventor: Viswanathan Panchanathan, Anderson, Ind.

[73] Assignee: Magnequench International, Inc., Anderson, Ind.

[21] Appl. No.: 09/407,352

[22] Filed: Sep. 29, 1999

[51] Int. Cl.[7] ..... H01F 1/053

[52] U.S. Cl. ..... 148/302; 148/101; 419/30

[58] Field of Search ..... 148/101; 419/30; 75/255

[56] References Cited

U.S. PATENT DOCUMENTS

| | | | |
|---|---|---|---|
| 5,244,510 | 9/1993 | Bogatin | 148/104 |
| 5,286,307 | 2/1994 | Anderson | 148/302 |
| 5,567,891 | 10/1996 | Bogatin et al. | 75/244 |
| 5,781,843 | 7/1998 | Anderson et al. | 419/29 |

*Primary Examiner*—Ngoclan Mai
*Attorney, Agent, or Firm*—Pennie & Edmonds LLP

[57] ABSTRACT

A process for passivating rare-earth alloy powders such that magnets formed from the powders have fewer expansion defects is described. By exposing the rare-earth alloy powders to a humid atmosphere, rare-earth oxide impurities that could result in eruptions in the magnets are reduced. Magnets made from the passivated powder show fewer expansion defects than magnets made from unpassivated powder.

31 Claims, No Drawings

RARE-EARTH ALLOY POWDERS FOR MAGNETS AND PROCESS FOR MAKING MAGNETS FROM RARE-EARTH ALLOY POWDERS

FIELD OF THE INVENTION

The present invention relates to making rare-earth magnetic alloy powders and more particularly, to reducing expansion defects in the magnets made from rare-earth alloy powders.

BACKGROUND OF THE INVENTION

Magnets formed from Nd—Fe—B powders find applications in a wide spectrum of industries, including computer hardware, automobiles, consumer electronics and household appliances. The magnets from these powders often suffer from expansion defects due to the presence of $Nd_2O$ particles in the powders. The $Nd_2O_3$ particles are impurities in the magnet—they may come from the powders that form the magnet or they may be formed in the magnet during the process by which the magnet is made from the powders. The $Nd_2O_3$ particles in a magnet adversely affect the properties of the magnet because these particles react with moisture to form $Nd(OH)_3$:

$$Nd_2O_3+3H_2O \rightarrow 2Nd(OH)_3.$$

The density ρ of $Nd(OH)_3$ is less than the density of $Nd_2O_3$:

$$\rho(Nd_2O_3)=7.28\ g/cm^3,$$

$$\rho(Nd(OH)_3)=5.60\ g/cm^3.$$

As a result of this decrease in density after the $Nd_2O_3$ particles react with moisture, there is an expansion that is sufficient to cause an eruption in the magnet. If the air gap is very small, the resulting eruption may stall the motor as a result of the defect.

OBJECTS OF THE INVENTION

It is therefore an object of the present invention to provide a rare-earth alloy magnet that will not substantially degrade as a result of exposure to humidity.

It is another object of the invention to provide a process by which the formation of rare-earth hydroxides is prevented or substantially reduced in rare-earth magnetic powders that are used to form rare-earth alloy magnets.

It is still a further object of the invention to provide a process by which the formation of rare-earth hydroxides in a magnet made of rare earth powders after the magnet is made is prevented or substantially reduced.

SUMMARY OF THE INVENTION

In accordance with the present invention, the presence of rare-earth hydroxide in rare-earth alloy powders is prevented or substantially reduced by passivation of the powders. The invention further provides magnets made from such passivated rare-earth alloy powders.

In accordance with the present invention, the rare-earth alloy powders are treated in a humid atmosphere to convert the undesirable oxide impurities to hydroxides prior to making the magnets. In this way, formation of hydroxides after the magnets are made is eliminated or substantially reduced, thereby preventing stalling due to expansion defects in service.

In accordance with the present invention, a magnet is made from rare-earth alloy powders. The powders have an alloy composition comprising approximately 15 to 34 weight percent of a rare earth, 0.8 to 1.2 weight percent of B, balanced with at least one of Fe and Co, wherein the rare earth is understood to mean one or more elements selected from the group consisting of Y, La, Ce, Pr, Nd, Sm, Er, Gd, Tb, Dy, Ho, Er, Tm, Yb, and Lu. Preferably, the proportion of the rare earth in the alloy is approximately 25 to 32 weight percent.

Other metals may also be present in minor amounts of up to two weight percent, either alone or in combination. These metals include tungsten, chromium, nickel, aluminum, copper, magnesium, manganese, gallium, vanadium, molybdenum, tantalum, zirconium, tin, and calcium. Silicon may also be present in small amounts, as may be oxygen, hydrogen, and nitrogen. As used herein, the term "rare earth alloy magnet" includes a magnetic particle or magnetic powder, a bonded magnet made from such a magnetic particle or magnetic powder, and a fully dense isotropic or anisotropic magnet.

DETAILED DESCRIPTION OF THE INVENTION

The present invention will be described in detail with the following examples.

EXAMPLE 1

A Nd—Fe—B alloy having a nominal composition of 27.5 weight percent of Nd, 5.0 weight percent of Co, 0.9 weight percent of B, and balanced with Fe, was melt spun to form microcrystalline ribbons. It was subsequently crushed into powders with an average particle size of approximately 200 μm and annealed at 640° C. The magnetic properties of the powder after annealing were as follows: $B_r$ was 8.28 kG; $H_{ci}$ was 9.22 kOe; $BH_{max}$ was 12.1 MGOe; and the oxygen content was 0.04 weight percent. Subsequently, to about 10 pounds of powder, 0.02 weight percent of $Nd_2O_3$ was added. Also, 2 weight percent of epoxy and 0.1 weight percent of zinc stearate were added. They were mixed and green compacts were made at 40 tsi. The compacts were then cured at 170° C. for 30 minutes. The resulting magnets had a length of 39.2 mm, a width of 7.2 mm, and a thickness of 1.8 mm. A total of 900 magnets were fabricated and they were exposed at a temperature of about 85° C. and a relative humidity of about 85 percent for fifteen hours. The magnets were then examined under a microscope at a magnification of 10. The defect could be observed in 25 of the 900 magnets.

EXAMPLE 2

Powders were prepared as in Example 1, mixed with 0.02 weight percent $Nd_2O_3$. The mixed powders were exposed at 85° C. and 85 percent humidity for 16 hours. This was followed by drying at 92° C. for 8 hours. This powder was then mixed with 2 percent epoxy and 0.1 percent zinc stearate, and 900 bonded magnets were made as in Example 1. They were exposed at a temperature of about 85° C. and a relative humidity of about 85 percent for fifteen hours and examined under a microscope. The defect could not be observed in any of the 900 magnets.

EXAMPLE 3

Powders were prepared as in Example 1, mixed with 0.02 weight percent $Nd_2O_3$, and exposed at a temperature of about 85° C. and a relative humidity of about 85 percent for 16 hours, followed by drying at 92° C. for 8 hours. The powder had the following magnetic properties: $B_r$ was 8.24 kG; $H_{ci}$ was 9.42 kOe; $BH_{max}$ was 12.0 MGOe; and the oxygen content was 0.059 weight percent. In comparison to the properties in Example 1, it should be noted that the magnetic properties were nearly the same, but the oxygen content was slightly increased.

EXAMPLE 4

Nd—Fe—B powders were prepared as in Example 1. The magnetic properties were as follows: $B_r$ was 8.30 kG; $H_{ci}$ was 9.43 kOe; $BH_{max}$ was 12.1 MGOe; and the oxygen content was 0.042 percent. To this powder, 0.0014 percent $Nd_2O_3$ was added and tests were carried out as described in Example 1. Of the 900 magnets prepared, defects were observed in 2 of the magnets.

EXAMPLE 5

The powder of Example 4 was mixed with 0.0014 percent $Nd_2O_3$. It was then exposed at a temperature of 85° C. and a relative humidity of 85 percent for 4 hours, followed by drying at 92° C. for two hours. Magnets were fabricated and tests were carried out as in Example 2. There were no defective magnets.

EXAMPLE 6

The powder of Example 4 was mixed with 0.0014 percent $Nd_2O_3$. In this instance, two separate trials were carried out. First, samples were exposed at a temperature of about 85° C. and a relative humidity of about 85 percent for three hours followed by drying at 92° C. for two hours. Second, samples were exposed at the same conditions for two hours followed by drying at 92° C. for two hours. In both cases, magnets were made and tested for defects after exposure at a temperature of 85° C. and a relative humidity of 85 percent for 15 hours. No defective magnets were observed for either trial.

EXAMPLE 7

The powder of Example 4 was mixed with 0.0014 percent $Nd_2O_3$, and then exposed for 4 hours at a temperature of 85° C. and a relative humidity of 85 percent, followed by drying at 92° C. for 2 hours. The magnetic properties of the powder were then as follows: $B_r$ was 8.30 kG; $H_{ci}$ was 9.39 kOe; $BH_{max}$ was 12.3 MGOe; and the oxygen content was 0.047 percent. It should be noted that although the magnetic properties are nearly the same as in Example 4, the oxygen content is increased by 0.005 percent.

The examples described above demonstrate that the magnetic properties of the Nd—Fe—B powders are not affected by the passivation treatment. This treatment helps in the elimination of defects, especially due to the reaction of $Nd_2O_3$ with moisture. No defects could be observed in any of the magnets fabricated from powders subjected to this treatment. While the examples are shown only for Nd-based alloy powders, the treatment is applicable for any magnet containing other types of rare earth. Also, although the examples are shown only for compression-molded bonded magnets, the treatment can be used for any other type of magnet fabrication, including bonded and fully dense magnets. These fabrication methods include injection molding extrusion, calendaring, hot press, hot deformed magnets, etc.

Although the present invention has been described with reference to examples, it will be appreciated by those of ordinary skill in the art that modifications can be made to the structure and form of the invention without departing from its spirit and scope, which is defined in the following claims.

What is claimed is:

1. A process for passivating rare-earth alloy powders comprising the steps of:

(a) exposing said alloy powders to a humid atmosphere; and (b) drying said alloy powders.

2. The process according to claim 1, wherein said humid atmosphere has a relative humidity greater than approximately 50 percent.

3. The process according to claim 2, wherein said humid atmosphere has a relative humidity approximately between 75 percent and 95 percent.

4. The process according to claim 1, wherein said humid atmosphere has a temperature approximately between 40° C. and 130° C.

5. A process for passivating rare-earth alloy powders comprising the steps of:

(a) exposing alloy powders to a humid atmosphere, the powders having a composition comprising approximately 15 to 34 weight percent of RE, 0.8 to 1.2 weight percent of B, balanced with at least one of Fe and Co, wherein RE is one or more rare-earth elements selected from the group consisting of Y, La, Ce, Pr, Nd, Sm, Er, Gd, Tb, Dy, Ho, Er, Tm, Yb, and Lu; and (b) drying said powders.

6. The process according to claim 5, wherein said humid atmosphere has a relative humidity greater than approximately 50 percent.

7. The process according to claim 6, wherein said humid atmosphere has a relative humidity approximately between 75 percent and 95 percent.

8. The process according to claim 5, wherein said humid atmosphere has a temperature approximately between 40° C. and 130° C.

9. The process according to claim 5, wherein the proportion of RE in the composition is approximately between 25 and 32 weight percent.

10. The process according to claim 5, wherein the proportion of Co in the composition is from 0 to 15 weight percent.

11. A passivated rare-earth alloy powder made by a process comprising the steps of:

(a) fabricating alloy powders having a composition comprising approximately 15 to 34 weight percent of RE, 0.8 to 1.2 weight percent of B, balanced with at least one of Fe and Co, wherein RE is one or more rare-earth elements selected from the group consisting of Y, La, Ce, Pr, Nd, Sm, Er, Gd, Tb, Dy, Ho, Er, Tm, Yb, and Lu; and (b) exposing said powders to a humid atmosphere; and (c) drying said powders.

12. The passivated rare-earth alloy powder of claim 11, wherein said humid atmosphere has a relative humidity greater than approximately 50 percent.

13. The passivated rare-earth alloy powder of claim 12, wherein said humid atmosphere has a relative humidity approximately between 75 percent and 95 percent.

14. The passivated rare-earth alloy powder of claim 11, wherein said humid atmosphere has a temperature approximately between 40° C. and 130° C.

15. The passivated rare-earth alloy powder of claim 11, wherein the proportion of RE in the composition is approximately between 25 and 32 weight percent.

16. The passivated rare-earth alloy powder of claim 11, wherein the proportion of Co in the composition is from 0 to 15 weight percent.

17. A process for producing a rare-earth alloy magnet comprising the steps of:

(a) exposing alloy powders to a humid atmosphere, the powders having a composition comprising approximately 15 to 34 weight percent of RE, 0.8 to 1.2 weight percent of B, balanced with at least one of Fe and Co, wherein RE is one or more rare-earth elements selected from the group consisting of Y, La, Ce, Pr, Nd, Sm, Er, Gd, Tb, Dy, Ho, Er, Tm, Yb, and Lu;

(b) drying said powders; and (c) fabricating the rare-earth alloy magnet from said powders.

18. The process according to claim 17, wherein said humid atmosphere has a relative humidity greater than approximately 50 percent.

19. The process according to claim 18, wherein said humid atmosphere has a relative humidity approximately between 75 percent and 95 percent.

20. The process according to claim 17, wherein said humid atmosphere has a temperature approximately between 40° C. and 130° C.

21. The process according to claim 17, wherein the proportion of RE in the composition is approximately between 25 and 32 weight percent.

22. The process according to claim 17, wherein the proportion of Co in the composition is from 0 to 15 weight percent.

23. The process according to claim 17, wherein the step of fabricating the rare-earth alloy magnet is accomplished by a method selected from the group consisting of compression molding, injection molding, extruding, calendaring, hot pressing, and hot deforming.

24. A rare-earth alloy magnet made by:

(a) exposing alloy powders to a humid atmosphere, the powders having a composition comprising approximately 15 to 34 weight percent of RE, 0.8 to 1.2 weight percent of B, balanced with at least one of Fe and Co, wherein RE is one or more rare-earth elements selected from the group consisting of Y, La, Ce, Pr, Nd, Sm, Er, Gd, Tb, Dy, Ho, Er, Tm, Yb, and Lu;

(b) drying said powders; and (c) fabricating the rare-earth alloy magnet from said powders.

25. The rare-earth alloy magnet of claim 24, wherein said humid atmosphere has a relative humidity greater than approximately 50 percent.

26. The rare-earth alloy magnet of claim 25, wherein said humid atmosphere has a relative humidity approximately between 75 percent and 95 percent.

27. The rare-earth alloy magnet of claim 24, wherein said humid atmosphere has a temperature approximately between 40° C. and 130° C.

28. The rare-earth alloy magnet of claim 24, wherein the proportion of RE in the composition is approximately between 25 and 32 weight percent.

29. The rare-earth alloy magnet of claim 24, wherein the proportion of Co in the composition is from 0 to 15 weight percent.

30. The rare-earth alloy magnet of claim 24, wherein the step of fabricating the rare-earth alloy magnet is accomplished by a method selected from the group consisting of compression molding, injection molding, extruding, calendaring, hot pressing, and hot deforming.

31. The rare-earth alloy magnet of claim 24 exhibiting a maximum energy product of no less than 4 MGOe.

* * * * *